US010241453B2

(12) United States Patent
Aiba et al.

(10) Patent No.: US 10,241,453 B2
(45) Date of Patent: Mar. 26, 2019

(54) FIXING DEVICE

(71) Applicant: CANON KABUSHIKI KAISHA, Tokyo (JP)

(72) Inventors: Hirohiko Aiba, Suntou-gun (JP); Satoru Taniguchi, Mishima (JP); Takashi Honke, Mishima (JP); Masaki Hirose, Suntou-gun (JP); Mahito Yoshioka, Numazu (JP); Taisuke Minagawa, Suntou-gun (JP); Fumiki Inui, Mishima (JP); Keita Nakajima, Mishima (JP); Kazushi Nishikata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/844,776

(22) Filed: Dec. 18, 2017

(65) Prior Publication Data

US 2018/0107141 A1 Apr. 19, 2018

Related U.S. Application Data

(62) Division of application No. 15/272,692, filed on Sep. 22, 2016, now Pat. No. 9,880,500.

(30) Foreign Application Priority Data

Sep. 25, 2015 (JP) ..... 2015-188321
Jul. 21, 2016 (JP) ..... 2016-143011

(51) Int. Cl.
*G03G 15/20* (2006.01)

(52) U.S. Cl.
CPC ..... *G03G 15/2053* (2013.01); *G03G 15/2017* (2013.01); *G03G 15/2025* (2013.01)

(58) Field of Classification Search
CPC ..... G03G 15/2017; G03G 15/2053; G03G 15/2064; G03G 2215/2035
See application file for complete search history.

(56) References Cited

U.S. PATENT DOCUMENTS 5,210,579 A * 5/1993 Setoriyama ..... 399/338
2006/0182474 A1 8/2006 Naito et al.
(Continued)

FOREIGN PATENT DOCUMENTS

JP 04-44075 A 2/1992
JP 06-194977 A 7/1994
JP 2007-057851 A 3/2007

OTHER PUBLICATIONS

European Search Report issued in corresponding European Application No. 16188032.3 dated Mar. 17, 2017.

*Primary Examiner* — Sandra Brase
(74) *Attorney, Agent, or Firm* — Venable LLP

(57) ABSTRACT

A fixing device for fixing an image formed on a recording material onto the recording material. The fixing device includes a heater contacting an inner surface of the film, a supporting member for supporting the heater, the supporting member being provided in a hollow space, a first portion for preventing lateral movement of the film in a generatrix direction of the film, the first portion being supported by a frame of the fixing device and holding the supporting member, and a second portion opposed to a surface of the heater where the heater contacts the film and elongated along a widthwise direction of the heater, the second portion being provided at the same position with the generatrix direction of the film.

18 Claims, 9 Drawing Sheets

(56) References Cited

U.S. PATENT DOCUMENTS

| | | | | |
|---|---|---|---|---|
| 2010/0202809 | A1 | 8/2010 | Shinshi et al. | |
| 2010/0290822 | A1 | 11/2010 | Hasegawa et al. | |
| 2011/0026987 | A1 | 2/2011 | Hasegawa | |
| 2011/0129267 | A1 | 6/2011 | Arimoto et al. | |
| 2012/0308279 | A1* | 12/2012 | Tanaka et al. | 399/329 |

* cited by examiner (a)

(b)

FIXING DEVICE

This application a divisional of U.S. patent application Ser. No. 15/272,692, filed Sep. 22, 2016.

FIELD OF THE INVENTION AND RELATED ART

The present invention relates to a fixing device to be mounted in an image forming apparatus, such as an electrophotographic copying machine or an electrophotographic printer.

As the fixing device mounted in the electrophotographic copying machine or printer, a fixing device using a cylindrical film has been known, such as the fixing device described in Japanese Laid-Open Patent Application (JP-A) (Hei 4-44075). This fixing device includes a cylindrical film and a heater including an electrode portion, contacting an inner surface of the film, for supplying electrical power to a longitudinal end portion. A toner image on a recording material is fixed on the recording material by heat of the film.

The fixing device has advantages such as shortening of warm-up time and low electric power consumption. Incidentally, onto a heater surface of the fixing device contacting the inner surface of the film, a lubricant is applied. When downsizing of the fixing device advances in the future, it would be considered that a part of the lubricant applied to the heater moves and is liable to reach the electrode portion provided at the longitudinal end portion of the heater. When the lubricant reaches the electrode portion, there is a possibility that electric power supply to the heater causes an inconvenience.

SUMMARY OF THE INVENTION

According to one aspect, the present invention provides a fixing device comprising a cylindrical film, a plate heater contacting an inner surface of the film and including an electrode portion for supplying electrical power to the heater, wherein the electrode portion is provided outside an end portion of the film with respect to a longitudinal direction of the film at an end portion of the heater with respect to a longitudinal direction of the heater, and a lubricant is applied in a region where the heater contacts the film, a supporting member for supporting a surface of the heater opposite from a surface of the heater where the heater contacts the film, and a sealing member contacting a surface of the heater where the electrode portion of the heater is provided, the sealing member being provided at a position closer to a center of the heater than the electrode portion is, wherein an image on a recording material is heated by heat of the film and is fixed on the recording material, and wherein the sealing member includes an engaging portion engaging with an end portion of the supporting member with respect to a widthwise direction of the heater and a cantilever contact portion contacting the surface of the heater where the electrode portion is provided.

According to another aspect the present invention provides a fixing device comprising a cylindrical film, a plate heater contacting an inner surface of the film and including an electrode portion for supplying electrical power to the heater, wherein the electrode portion is provided outside of an end portion of the film with respect to a longitudinal direction of the film at an end portion of the heater with respect to a longitudinal direction of the heater, and a lubricant is applied in a region where the heater contacts the film a supporting member for supporting a surface of the heater opposite from a surface of the heater where the heater contacts the film, and a sealing member contacting a surface of the heater where the electrode portion of the heater is provided, the sealing member being provided at a position closer to a center of the heater than the electrode portion is, wherein an image on a recording material is heated by heat of the film and is fixed on the recording material, and wherein the sealing member is mounted to the supporting member by sliding with the supporting member with respect to the longitudinal direction of the heater.

Further features of the present invention will become apparent from the following description of exemplary embodiments with reference to the attached drawings.

DESCRIPTION OF THE EMBODIMENTS

In the following, embodiments of the present invention will be described with reference to the drawings. The following embodiments are an example of preferred embodiments of the present invention, but the present invention is not limited to the following embodiments. It is possible to replace constitutions with other constitutions within the scope of the concept of the present invention.

Embodiment 1

(1) Image Forming Apparatus

Figure 11:
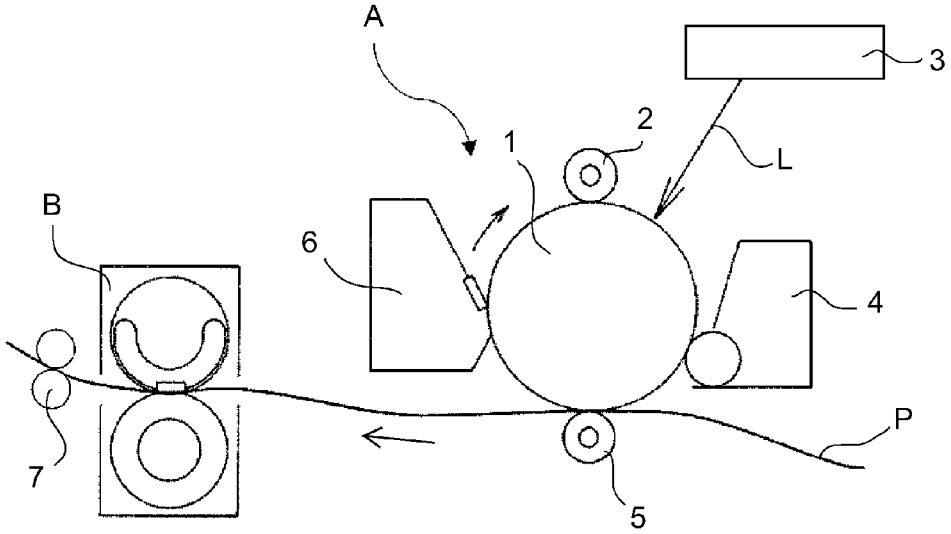
FIG. 11 is a sectional view showing a schematic structure of an image forming apparatus.

With reference to FIG. 11, an image forming apparatus in which a fixing device according to the present invention is mounted will be described. FIG. 11 is a sectional view showing a schematic structure of an example of an image forming apparatus (monochromatic laser printer in this embodiment) using an electrophotographic recording technology.

In the image forming apparatus, an image forming portion A for forming an image on a recording material P includes a photosensitive drum 1 as an image bearing member, a charging member 2, a laser scanner 3. Further, the image forming portion A includes a developing device 4, a cleaner 6 for cleaning an outer peripheral surface of the photosensitive drum 1, and a transfer member 5. An operation of the image forming portion A is well known and therefore detailed description will be omitted.

The recording material P accommodated in a cassette (not shown) is fed by rotation of a roller (not shown) to a transfer portion formed by the photosensitive drum 1 and the transfer member 5. The recording material P on which the toner image is transferred at the transfer portion is fed to a fixing device (fixing portion) B, and the toner image is heat-fixed on the recording material P by the fixing device B. The recording material P coming out of the fixing device B is discharged onto a tray (not shown).

(2) Fixing Device B

Figure 2:
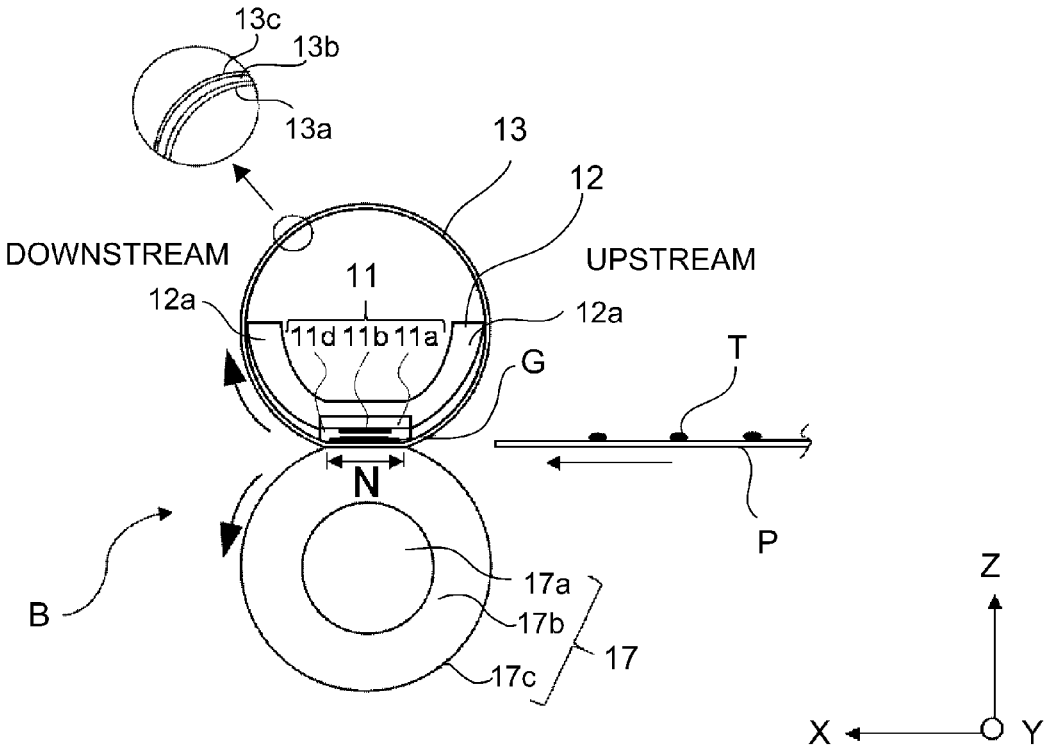
FIG. 2 is a sectional view showing a schematic structure of the fixing device in Embodiment 1.
Figure 3:
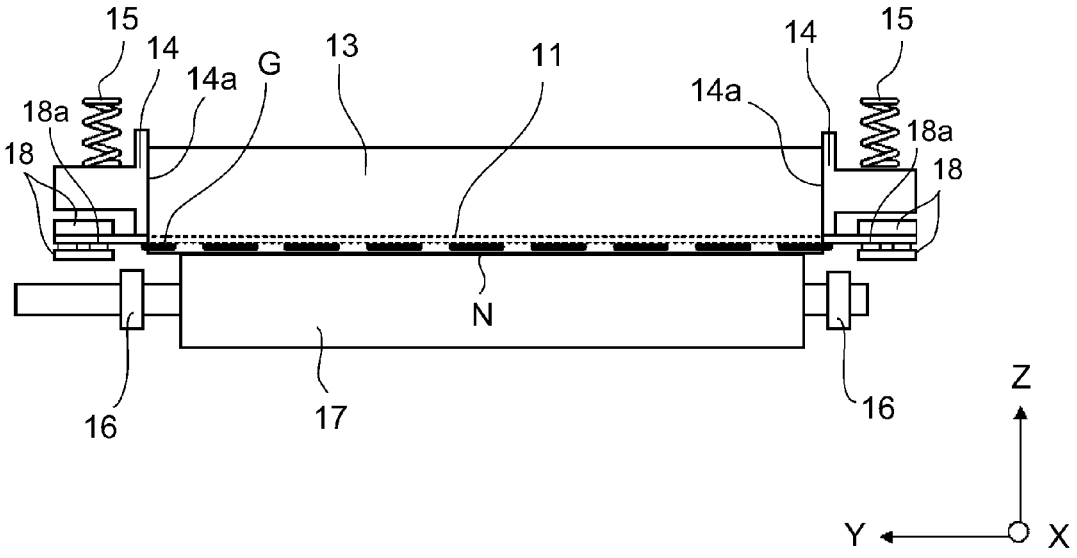
FIG. 3 is a front view of the fixing device in Embodiment 1 before the sealing member is provided, as seen from the upstream side with respect to the recording material feeding direction.
Figure 4:
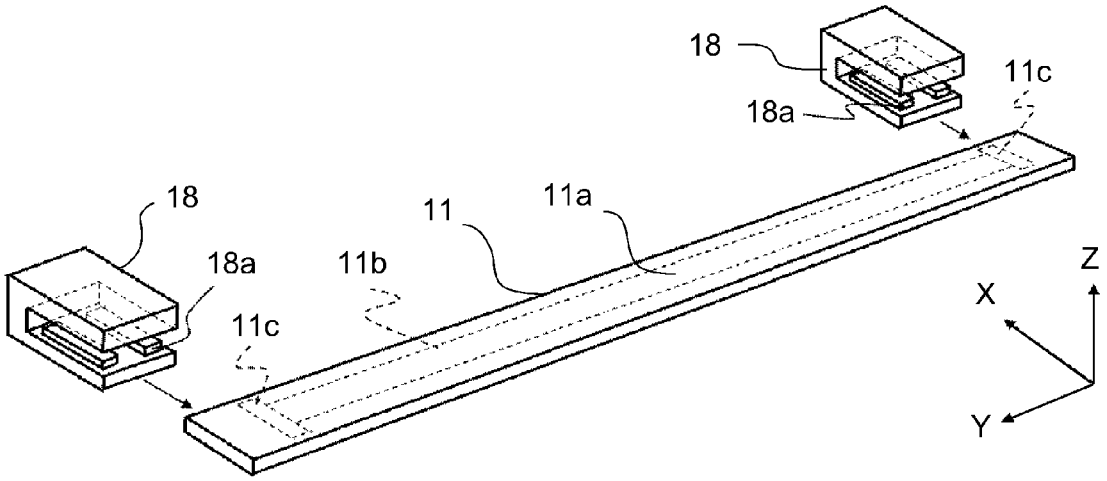
FIG. 4 is a schematic view for illustrating an electrode of a heater and an electric power supplying portion of a connector.

The fixing device B in this embodiment is a fixing device of a film heating type. FIG. 2 is a sectional view showing a schematic structure of the fixing device B in this embodiment. FIG. 3 is a front view of the fixing device B in this embodiment before a sealing member 21 is provided, when the fixing device B is seen from an upstream side with respect to a feeding direction of the recording material P (hereinafter this direction is referred to as X-axis direction). FIG. 4 is a schematic view for illustrating an electrode portion 11*c* of a heater 11 and an electric power supplying portion 18*a* of a connector 18.

The fixing device B in this embodiment includes a cylindrical film 13 as a cylindrical rotatable heating member, the heater 11, a pressing roller 17 as a rotatable pressing member for forming a nip N through the film 13 in cooperation with the heater 11, and the connector 18 as an end portion supplying member. The fixing device B further includes a film guide 12 as a supporting member and a flange 14 as a regulating member.

(2-1) Heater 11

With respect to Y-axis direction (FIG. 4) perpendicular to the X-axis direction, the heater 11 includes an elongated thin substrate 11*a*. As the substrate 11*a*, an insulating ceramic substrate of alumina (aluminum oxide), AlN (aluminum nitride), or the like, or a heat-resistant resin substrate of polyimide, PPS, liquid crystal polymer, or the like, is used.

On a surface of the substrate 11*a*, a heat generating resistor 11*b* of Ag/Pd (silver/palladium), $RuO_2$, $Ta_2N$ or the like, is provided along a longitudinal direction of the substrate 11*b*. In the following, for convenience of description, the heat generating resistor 11*b* is referred to as a heat generating layer 11*b*. Further, on a surface of the substrate 11*a*, the electrode portion 11*c* for supplying electrical power to the heat generating layer 11*b* and a protective layer 11*d*, for ensuring protection and providing an insulating property of the heat generating layer 11*b* (FIG. 2), including glass coating, a fluorine-containing layer, a polyimide layer or the like are provided.

The electrical power supply to the heat generating layer 11*b* is made through a contact portion 18*a* of the connector 18 mountable to the heater 11 (FIG. 4). Here, the connector 18 is mounted to the substrate 11*a* of the heater 11 at a longitudinal end portion of the heater 11, so that the contact portion 18*c* contacts the electrode portion 11*c* of the heater 11. As a result, the electrical power supply from the contact portion 18*a* to the electrode portion 11*c* can be made. Incidentally, in FIG. 4, for convenience of description, the protective layer 11*d* is omitted from illustration.

In this embodiment, the heater 11 prepared by printing the heat generating layer 11*b* of Ag/Pd on the alumina substrate 11*a* of 270 mm in width with respect to the Y-axis direction, 8.75 nm in width with respect to the X-axis direction, and 0.635 mm in thickness with respect to Z-axis direction and then by providing the glass coating layer as the protective layer 11*d* is used. Here, the Z-direction is a direction perpendicular to each of the X-axis direction and the Y-axis direction and is also a thickness direction of the heater 11.

(2-2) Film Guide 12

With respect to the Y-axis direction, the film guide 12 inserted into a hollow portion of the film 13, so that the film guide 12 holds the heater 11 on its surface in a side toward the pressing roller 17. Here, the heater 11 held by the film guide 12 opposes the pressing roller 17 with respect to a radial direction of the film 13. The film guide 12 includes a guiding portion 12*a*, for guiding the film 13 during rotation motion, at each of an upstream end portion and a downstream end portion with respect to the X-axis direction thereof.

The film guide 12 is a member having rigidity, a heat-resistant property and a heat-insulating property and is formed of the liquid crystal polymer, a phenolic resin, PPS, PEEK or the like. In this embodiment, the liquid crystal polymer is used.

(2-3) Film 13

The film 13 is constituted by a base layer 13*a* consisting of a flexible endless belt, an elastic layer 13*b* provided on an outer peripheral surface of the base lubricant 13*a*, and a parting layer 13*c* provided on an outer peripheral surface of the elastic layer 13*b*.

The base layer 13*a* is formed in a thickness of 200 μm or less for enabling quick start by a metal material such as stainless steel, Al, Ni, Cu or Zn, or a resin material such as polyimide, having the heat-resistant property and a heat-conductive property. On the other hand, in order to constitute the fixing device B usable for a long term, as the base layer 13*a* having sufficient strength and excellent durability, a layer having a (film) thickness of 15 μm or more is needed. At an inner surface of the base layer 13*a* contacting the heater 11, a lubricant having a high lubricating property such as a fluorine-containing resin, polyimide or polyamideimide may also be formed.

The elastic layer 13*b* is formed with a heat-resistant elastic member such as a silicone rubber in order to conduct to an unfixed toner image T carried on the recording material P in an enclosed manner so as to sufficiently satisfy a toner fixing property and to prevent fixing non-uniformity, thereby to realize high image quality and speed-up. In order to meet image quality improvement and speed-up by a heat enclosing effect, a layer thickness of the elastic layer 13*b* is required to be 30 μm or more. On the other hand, in order to enable a quick-start property, the layer thickness is required to be 500 μm or less. Further, in order to improve thermal conductivity, the elastic layer 13*b* contains a thermal (heat)-conductive filler.

The parting layer 13*c* is disposed on the outer peripheral surface of the elastic layer 13*b* by tube molding or coating of a fluorine-containing resin material such as PFA, PTFE or FEP in order to improve a parting property and anti-wearing property. As regards the parting layer 13*c*, the layer thickness is required to be 5 μm or more for the anti-wearing property against the recording material P and is required to be 100 μm or less for enabling quick start.

In this embodiment, a film 13 is used, which has an outer diameter of 24 mm and, which includes a 70 μm-thick lubricant of polyimide used as the base layer 13*a*, a 270 μm-thick lubricant of a thermal-conductive silicone rubber used as the elastic layer 13*b*, and a 14 μm-thick lubricant of PFA as the parting layer 13*c*.

(2-4) Flange 14

With respect to the Y-axis direction, the flange 14 formed of a heat-resistant resin material and mounted at each of end portions of the film 13 with respect to a generatrix direction of the film 13 is held by each of left and right frames (not shown) of the fixing device B. Each of the flanges 14 holds an associated end portion of the film guide 12 by a supporting portion (not shown) inserted into the associated end portion of the film 13 so as to support the inner peripheral surface of the film 13 during rotational motion. Further, each of the flanges 14 prevents lateral movement of the film 13 in the generatrix direction by contact of the end portion of the film 13 during the rotational motion with a preventing (regulating) surface 14*a* thereof provided in a side toward the film 13.

(2-5) Pressing Roller 17

The pressing roller 17 is a member disposed opposed to the heater 11 through the film 13. The pressing roller 17 includes a metal core 17*a* formed of metal such as stainless steel, iron, or Al, and an elastic layer 17*b* formed of a heat-resistant rubber, such as a silicone rubber or a fluorine-containing rubber, or formed outside of the metal core 17*a* by floating with the silicone rubber. In order to improve the parting property and the anti-wearing property, on the outer peripheral surface of the elastic layer 17*b*, a parting layer 17*c* of PFA, PTFE, FEP, or the like, may also be provided.

In this embodiment, the pressing roller 17, which includes a lubricant of iron as the metal core 17*a*, a silicone rubber layer as the elastic layer 17*b*, in which an electroconductive filler is mixed, and a layer of PFA as the parting layer 17*c*, and which is twenty-five mm in outer diameter, is used. Further, in order to stabilize a feeding property of the recording material P, a reverse crown shape is imparted to the pressing roller 17 so that an outer diameter difference between an end portion and a central portion of the pressing roller 17 with respect to the Y-axis direction is 160 μm.

As the form of the pressing member, other than the pressing roller 17 in this embodiment, the form such as a rotatable belt may also be used.

As shown in FIG. 3, with respect to the Y-axis direction, both end portions of the metal core 17*a* of the pressing roller 17 are rotatably held by the above-described left and right frame through bearings 16. Further, between each flange 14 and an associated spring receiving member (not shown) in a left or right frame side, a pressing spring 15 is compressedly provided, so that a predetermined urging force is exerted on the film guide 12 through the flange 14.

When the urging force is applied to the film guide 12, the heater 11 urges the inner peripheral surface of the film 13, so that the outer peripheral surface of the film 13 is press contacted to the outer peripheral surface of the pressing roller 17. As a result, a nip (FIG. 2) having a predetermined width is formed by the protective layer 11*d* of the heater 11 and the parting layer 17*c* of the pressing roller 17 through the film 13.

(3) Fixing Operation

The pressing roller 17 is rotationally driven in an arrow direction (FIG. 2) by a motor (not shown). By following the rotation of the pressing roller 17, the film 13 is rotated while contacting the surface of the protective layer 11*d* of the heater 11 and the surface of the guiding portion 12*a* of the film guide 12 at the inner peripheral surface thereof.

From a power source (not shown), electric power is supplied to the electrode portion 11*c* of the heater 11 through an electric power supplying portion 18*a* of the connector 18, so that energization to the heat generating layer 11*b* is effected through the electrode portion 11*c*. As a result, the heat generating layer 11*b* generates heat, so that the heater 11 abruptly increases in temperature.

The temperature of the heater 11 is detected by a temperature detecting element (not shown) provided at a longitudinal central portion of the substrate 11*a* in a side opposite from the heat generating layer 11*b* of the heater 11. A temperature controller (not shown) controls a duty ratio, a wave number, or the like of a voltage applied from the electrode portion 11*c* to the heat generating layer 11*b*, on the basis of the temperature detected by the temperature detecting element, so that the temperature controller maintains a control temperature at a substantially constant fixing temperature (target temperature).

The recording material P carrying thereon the unfixed toner image T is heated at the nip N while being fed, so that the toner image T is fixed on the recording material P.

(4) Lubricant G

In order to reduce a frictional resistance of the film 13 with the heater 11 and the film guide 12, and to maintain a stable operation of the fixing device B throughout a durability test, a lubricant G (FIG. 3) is applied onto the inner surface of the film 13 and the surface of the protective layer 11*d* of the heater 11. That is, the lubricant G is applied to between the film 13 and the heater 11 in order to principally assist friction between the inner surface of the film 13 and the heater 11.

The heater 11 is used at a temperature of 180° C. or more in some cases, and therefore as the lubricant G, a fluorine-containing lubricant showing very good stability in a severe condition such as a high-temperature environment is used. The lubricant G is constituted by a base oil and a thickening agent, and an additive such as a preservative may also be added.

Further, onto also end surfaces of the end portions of the film 13 and the preventing surfaces 14*a* of the flanges 14, the lubricant G is similarly applied in order to suppress the frictional resistance to a low level.

That is, an application portion of the lubricant G is a sliding portion between the film 13 and the heater 11 and a sliding portion between the film 13 and the flanges 14.

In this embodiment, as the lubricant G, a lubricant ("MOLYKOTE HP-300", manufactured by Dow Corning Toray Co., Ltd.) using perfluoropolyether (PFPE) as the base oil and PTFE as the thickening agent is used. An application amount of the lubricant G is 500 mg at the sliding portion between the film 13 and the heater 11, and is 65 mg at each of the sliding portion between the film 13 and the right flange 14 and the sliding portion between the film 13 and the left flange 14.

(5) Sealing Member 21

When a part of the lubricant G (FIGS. 2 and 3) applied to the sliding portion between the film 13 and the heater 11 flows out from the end portions of the film 13, contact failure between a heater contact 18*a* of the connector 18 and the electrode portion 11*c* of the heater 11 generates in some cases.

Therefore, the fixing device B in this embodiment is provided with a sealing member 21 for suppressing the generation of the contact failure between the heater contact 18*a* and the electrode portion 11*c*.

Figure 1:
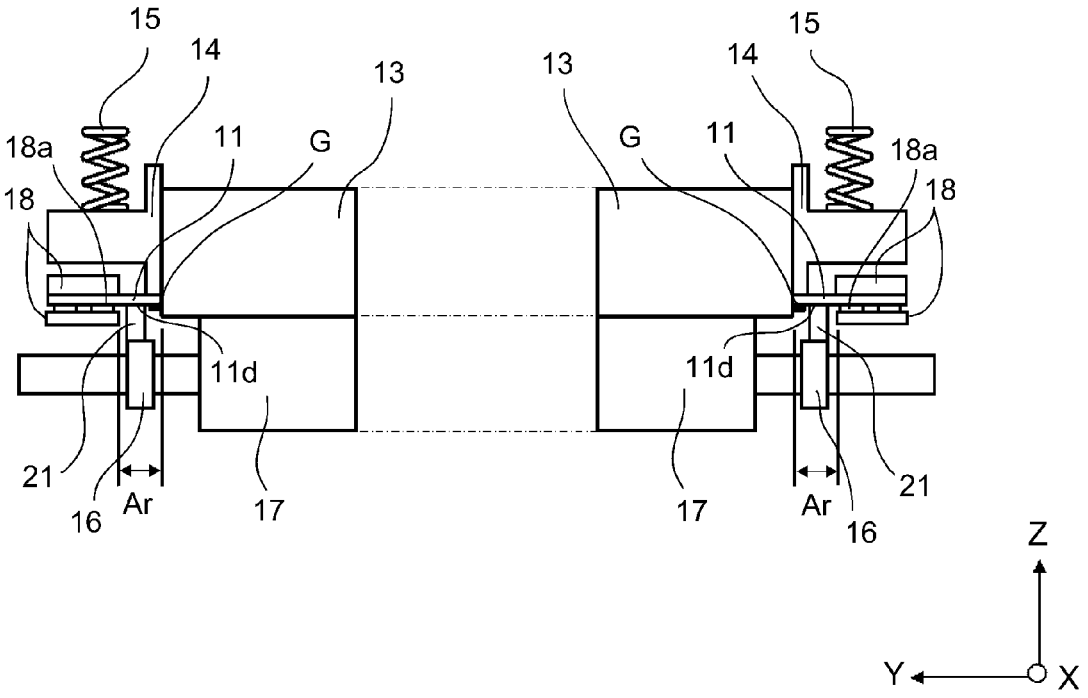
FIG. 1 is a front view of a fixing device including a sealing member in Embodiment 1 as seen from an upstream side with respect to a recording material feeding direction.
Figure 5:
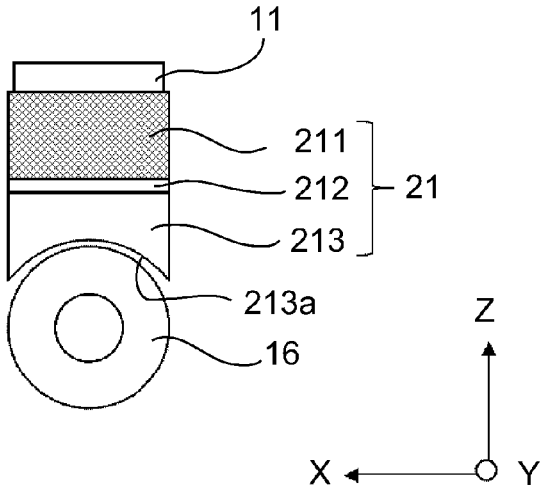
FIG. 5 is a schematic view for illustrating a positional relationship among a bearing of a pressing roller, the sealing member and the heater.

FIG. 1 is a front view of the fixing device B when the fixing device B in this embodiment including the sealing member 21 is seen from an upstream side with respect to the X-axis direction. FIG. 5 is a schematic view for illustrating a positional relationship among the bearing 16 of the pressing roller 17, the sealing member 21 and the heater 11 with respect to the Z-axis direction.

As shown in FIG. 1, with respect to the Y-axis direction, the sealing member 21 which is a member contacting the heater 11 in a region Ar outside the end portion of the film 13 and inside the connector 18 is disposed. That is, the sealing member 21 seals a gap between the connector 18 and the heater 11 in the region Ar.

As shown in FIG. 5, with respect to the Z-axis direction, the sealing member 21 is disposed so as to closely seal between the bearing 16 of the pressing roller 17 and the heater 11. Further, with respect to the X-axis direction, a widthwise dimension of the sealing member 21 is set so as to be a widthwise dimension or more of the heater 11.

The sealing member 21 includes a foam member 211, a heat-resistant tape 212 and a holder 213, and these members 211, 212, and 213 are integrated by bonding the foam member 211 and the holder 213 with the heat-resistant tape 212. The holder 213 includes a surface 213*a* (FIG. 5) having a shape engaging with the outer peripheral surface of the bearing 16 of the pressing roller 17, in a side toward the bearing 16, so that the holder 213 is held by the heater 11 and the bearing 16 by engagement of the surface 213*a* with the outer peripheral surface of the bearing 16.

When the urging force for forming the nip N is applied to the sealing member 21, the surface (film sliding surface) of the protective layer 11*d* of the heater 11 is press-contacted to the foam member 211 of the sealing member 21, and, therefore, it becomes possible to close (seal) the gap between the connector 18 and the heater 11.

Dimensions of the foam member 211 are as follows. A width with respect to the Y-axis direction is 4 mm. A width of the X-axis direction is set at 9 mm longer than 4 mm so as to cover an entire region of a width (8.75 mm) of the heater 11. A length with respect to the Z-axis direction is 4 mm as a natural length (no load state), but the urging force for forming the nip N acts on the heater 11 through the film guide 12 during assembling of the fixing device, and therefore the foam member 211 contracts to about 2 mm in length.

A material used as the sealing member 21 is required to have elasticity so as not to have the influence on a pressure distribution of the nip N formed by urging of the urging springs 15. In the fixing device B in this embodiment, a load of 215.6 N (about 22 kgf) in total pressure is uniformly applied by the urging springs 15. As a result of an experiment, in order to prevent the influence on the uniform pressure distribution, there was a need to suppress reaction of the sealing member to 5% or less of the total pressure.

Further, in order to cause the sealing member 21 to apply pressure to the surface of the heater 11 increasing in temperature up to about 200° C., the sealing member 21 is required to have a heat-resistant property. Further, a thermal conductive material may preferably be used so as not to prevent a fixing performance by taking heat from the heater 11.

In order to satisfy the properties required for the sealing member 21, in this embodiment, a polyimide foam member 211 having a heat-resistant property of about 300° C. was used in this embodiment. In order to decrease the reaction against the total pressure for forming the nip N, an experiment was conducted while changing an expansion ratio of polyimide. As a result of the experiment, in order to make the reaction 5% or less of the total pressure, there was a need to make the expansion ratio 5 times or more. On the other hand, when the expansion ratio is excessively high, density becomes small, and therefore it turned out that an effect of suppressing flow-out of the lubricant G lowered.

As a result of the experiment, in order to seal the lubricant G throughout a durability lifetime of the fixing device B, there was a need that the end portion was 300 times (magnifications) or less. From the above experimental result, in order to achieve balance between the reaction against the total pressure in the nip N and the effect of sealing the lubricant G, it was confirmed that the expansion ratio of polyimide of about 5-300 times was suitable. The expansion ratio of polyimide actually employed in this embodiment was 50 times.

That is, the sealing member 21 has elasticity such that pressure applied to the heater 11 by the sealing member 21 is 5% or less of pressure applied to the heater 11 by the pressing roller 17. Further, the sealing member 21 includes the foam 211 of 5-300 times in expansion ratio.

(6) Comparison Result of Embodiment 1 and Comparison Example

In order to check an effect of the fixing device B, a durability test was conducted for a fixing device in Comparison Example in which the sealing member 21 is not provided and the fixing device B in this embodiment in which the sealing member 211 is provided, and thus a comparison experiment as to whether or not the contact failure of the heater 11 generates was conducted. In this experiment, a monochromatic layer printer of 350 mm/sec in feeding speed of the recording material P and 300×1000 sheets in durability lifetime of the fixing device was used. A result is shown in Table 1 appearing hereinafter.

When the durability test of the product progressed, the lubricant G applied between the film 13 and the heater 11 gradually protrudes from the end portion of the film 13 by the influence of the pressure at the nip N and the rotation of the film 13. When the durability test is further continued, the lubricant G protruding from the end portion of the film 13 further flows toward an outside of the film 13 with progression of the durability test.

Figure 6:
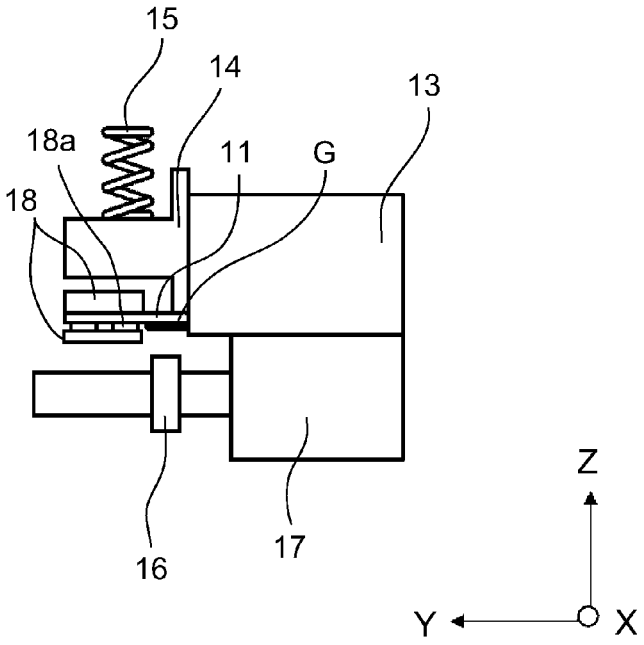
Fig. 6 Prior Art
FIG. 6 is a schematic view for illustrating a state in which a lubricant from an end portion of a film reaches a connector in a fixing device in Comparison Example.

FIG. 6 is a schematic view for illustrating a state in which the lubricant G protruding from the end portion of the film 13 reaches the connector 18 in the fixing device in the Comparison Example. In the fixing device in the Comparison Example in which the sealing member 21 is not provided, it is impossible to suppress flowing of the lubricant gap, protruding from the end portion of the film 13, toward an end portion of the heater 11. For that reason, the lubricant G reaches the connector 18 through the heater 11 and flows to the heater contact 18*a* through a gap between the connector 18 and the heater 11, so that the contact failure between the heater contact 18*a* of the connector 18 and the electrode portion 11*c* of the heater 11 generates.

In the fixing device in the Comparison Example, at the time when the recording materials P are passed through (introduced into) the nip N in about 200×1000 sheets, the lubricant G reached the heater contact 18*c* and thus generated the contact failure.

On the other hand, in the fixing device B in this embodiment, the sealing member 21 including the polyimide foam member 211 is disposed between the end portion of the film 13 and the connector 18 in contact with the heater 11. The lubricant G flowing out of the end portion of the film 13 is absorbed by the foam member 211 of the sealing member 21, and therefore it is possible to suppress that the lubricant G reaches the connector 18.

In the fixing device B in this embodiment, even after the recording materials P are passed through (introduced into) the nip N in about 200×1000 sheets, no contact failure due to lubricant G arrival at the heater contact 18*a* is generated.

TABLE 1

| | |
|---|---|
| Comparison Example | Generated (about 200k)*1 |
| Embodiment 1 | Not generated (300k)*2 |

*1Contact failure generated by sheet passing of about 200 × 1000 sheets.
*2Contact failure did not generate even after sheet passing of 300 × 1000 sheets.

In this embodiment, the sealing member 21 is provided so as to seal (close) between the bearing 16 of the pressing roller 17 and the surface of the protective layer 11*d* of the heater 11, but a placement position of the sealing member 21 is not limited thereto. The sealing member 21 may also be disposed at any position where the sealing member 21 can contact the heater 11 and the gap between the connector 18 and the heater 11 can be sealed (closed) in the region Ar between the end portion of the connector 18 and the heater 11.

Further, in this embodiment, the sealing member 21 including the polyimide foam member 211 is used, but the material of the sealing member 21 is not limited thereto when the material has the heat-resistant property such that the material can be used even in the fixing device B.

Embodiment 2

Another embodiment of the fixing device B will be described. In this embodiment, constituent members (portions) which are the same as those of the fixing device B in Embodiment 1 are represented by the same reference numerals (symbols) and will be omitted from description.

In the fixing device B in this embodiment, in the region Ar described in Embodiment 1, a sealing member 22 such as an adhesive or a thin sheet (film) is provided. The fixing device B in this embodiment is useful in the case where the fixing device B is of a small type and the space where the sealing member 21 is disposed as used in Embodiment 1 cannot be ensured. Also a widthwise dimension, with respect to the X-axis direction, of the sealing member 22 used in the fixing device B in this embodiment is set at a value which is not less than the widthwise dimension of the heater 11 similarly as in Embodiment 1.

(1) Sealing Member 22

Figure 7:
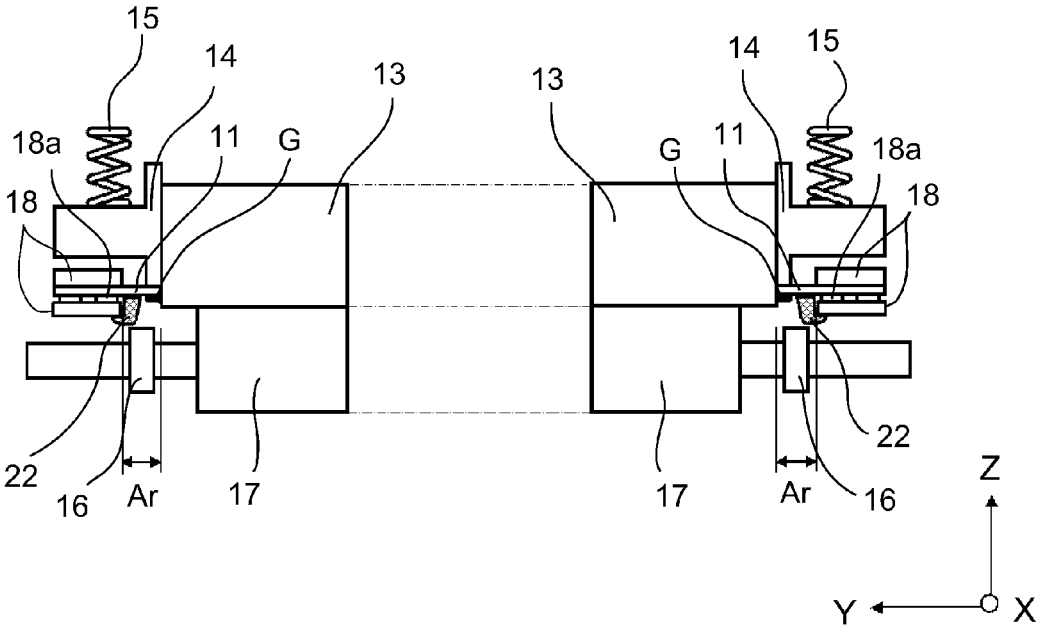
FIG. 7 is a front view of a fixing device including a sealing member in Embodiment 2 as seen from an upstream side with respect to a recording material feeding direction.

FIG. 7 is a front view of the fixing device B in this embodiment in which the sealing member 22 is provided, as seen from an upstream side with respect to the X-axis direction. Incidentally, the sealing member 22 is hatched in consideration of viewability.

The sealing member 22 is disposed in the region Ar in a shape as shown in FIG. 7. In this embodiment, as the sealing member 22, a silicone adhesive ("Dow Corning SE4485", manufactured by Dow Corning Toray Co., Ltd.) in applied and cured at positions shown in FIG. 7 and then is used, so that the gap between the connector 18 and the heater 11 is sealed (closed).

(2) Comparison Result of Embodiment 2 and Comparison Example

In order to check an effect of the fixing device B in this embodiment, a comparison experiment similar to that in Embodiment 1 was conducted. A result thereof is shown in Table 2 appearing hereinafter.

In the fixing device B in this embodiment, the lubricant G flowing out of the end portion of the film 13 is dammed by the sealing member 22. For that reason, the lubricant G can be retained inside as compared with the sealing member 22, so that it is possible to prevent the lubricant G from reaching the connector 18.

As a result, also in the fixing device B in this embodiment, even after the recording materials P are passed through (introduced into) the nip N in about 200×1000 sheets, no contact failure due to lubricant G arrival at the heater contact 18*a* is generated.

TABLE 2

| | |
|---|---|
| Comparison Example | Generated (about 200k)*1 |
| Embodiment 2 | Not generated (300k)*2 |

*1Contact failure generated by sheet passing of about 200 × 1000 sheets.
*2Contact failure did not generate even after sheet passing of 300 × 1000 sheets.

In this embodiment, as the sealing member 22, the silicone adhesive was used, but the sealing member 22 is not limited thereto.

Figure 8:
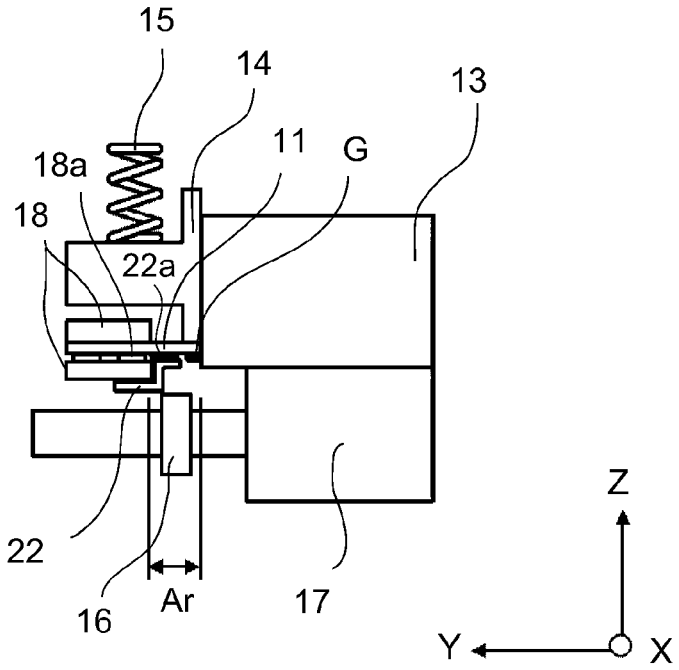
FIG. 8 is a schematic view for illustrating another example of the sealing member of the fixing device in Embodiment 2.
Figure 9:
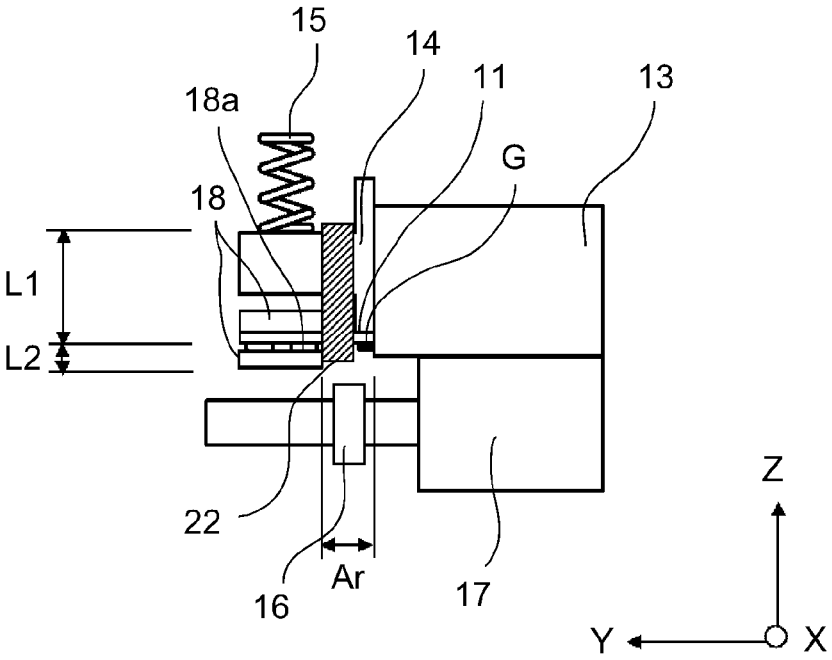
FIG. 9 is a schematic view for illustrating another example of the sealing member of the fixing device in Embodiment 2.
Figure 10:
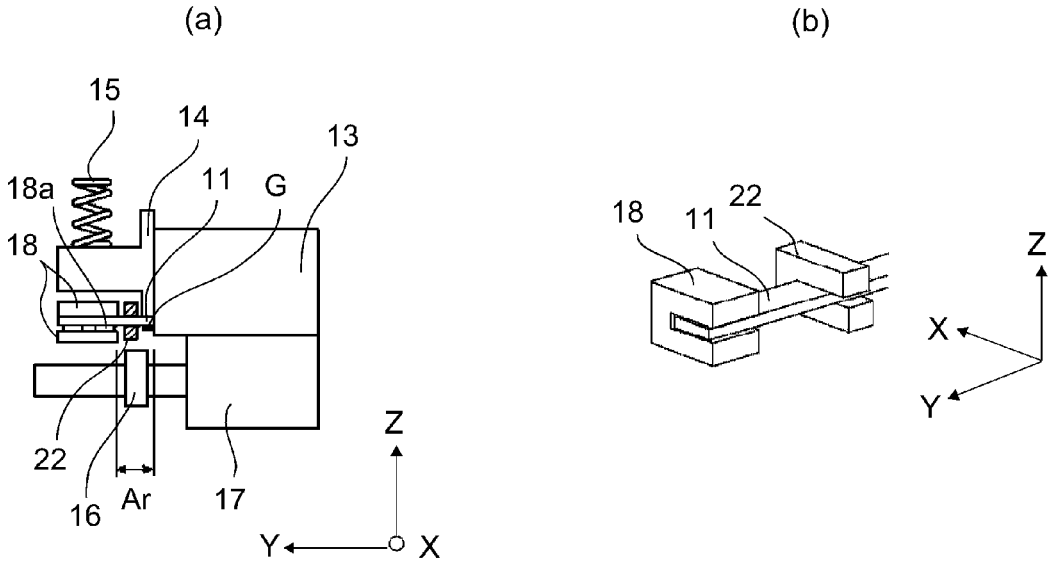
In FIG. 10, (a) and (b) are schematic views for illustrating another example of the sealing member of the fixing device in Embodiment 2.

FIGS. 8, 9 and 10 are schematic views each for illustrating another example of the sealing member 22.

As shown in FIG. 8, as the sealing member 22, a heat-resistant thin film sheet 22 having an adhesive layer 22*a* on one surface thereof is applied and contacted to the surface of the protective layer 11*d* of the heater 11 and the surface of the connector 18. As a result, the gap between the connector 18 and the heater 11 can be sealed, so that it is possible to prevent the lubricant G from reaching the connector 18.

Alternatively, also in a constitution such that a sealing member (not shown) is separately prepared and is applied and contacted to the surface of the protective layer 11*d* of the heater 11 in the region Ar to seal the gap between the connector 18 and the heater 11, a similar effect can be obtained.

Also, a shape of the sealing member 22 is not limited to those shown in FIGS. 7 and 8, but may also be any shape such that the sealing member 22 can seal the gap between the connector 18 and the heater 11.

As shown in FIG. 9, as the sealing member 22, it is also possible to use a material such as a heat-resistant silicone rubber. An elastic material such as the silicone rubber is molded into a rubber ring shape, and then the rubber ring is stretched around the heater 11 and the flange 14.

An inner diameter of the sealing member 22 having the rubber ring shape is made smaller than a distance L1 from a surface (toward the pressing spring 15) of the flange 14 opposite from the heater 11 to the surface of the protective layer 11*d* of the heater 11. A thickness of the sealing member 22 having the rubber ring shape is made larger than a distance L2 from the surface of the connector 18 in a side toward the heater 11 to the surface of the protective layer 11*d* of the heater 11. As a result, the sealing member 22 is closely contacted to the heater 11 by elasticity of the rubber, and, therefore, it is possible to seal the gap between the connector 18 and the heater 11, so that it is possible to prevent the lubricant G from reaching the connector 18.

As shown in (a) and (b) of FIG. 10, the sealing member 22 is molded into a shape similar to the shape of the connector 18 by using a heat-resistant resin material such as PPS or LCP, and is closely contacted to the heater 11 in such a manner that the sealing member 22 sandwiches the heater 11 in a U-shape in the region Ar. As a result, the gap between the connector 18 and the heater 11 can be sealed, so that it is possible to prevent the lubricant G from reaching the connector 18.

Embodiment 3

Embodiment 3 will be described. In this embodiment, constituent members (portions) which are the same as those of the fixing device B in Embodiment 1 are represented by the same reference numerals or symbols and will be omitted from description.

Figure 12A:
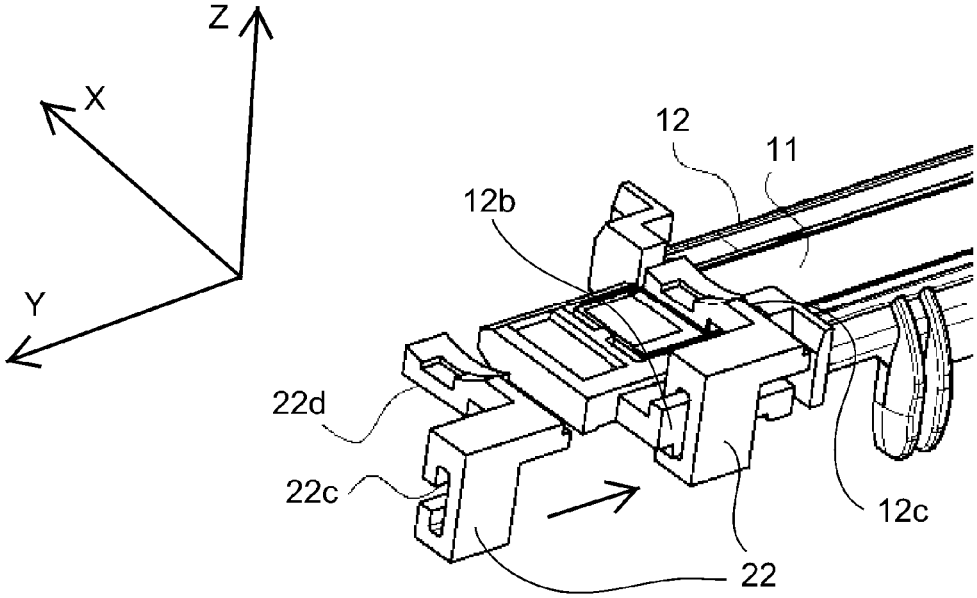
FIGS. 12A, 12B and 12C are schematic views showing a sealing member of a fixing device in Embodiment 3.

FIG. 12A is a schematic view showing the sealing member 22 and the film guide 12. The sealing member 22 is constituted so that the sealing member 22 slides with the film guide 12 in the longitudinal direction (Y-axis direction) of the film guide 12 and is mounted to the film guide 12. FIG. 12A shows states before and after the sealing member 22 is mounted to the film guide 12. An engaging portion 22*c* of the sealing member 22 engages with the portion-to-be-engaged provided at the end portion of the film guide 12 with respect to the widthwise direction of the film guide 12. A contact portion 22*d* of the sealing member 22 is a cantilever contact portion extending from the engaging portion 22*c* in the widthwise direction. The contact portion 22*d* contacts the heater 11 in a state in which the contact portion 22*d* is flexed and a preload is applied thereto. By this contact portion 22*d* of the sealing member 22, the lubricant G applied to a contact region of the film 13 with the heater 11 is prevented from flowing toward the electrode portion 11*c* of the heater 11.

Figure 12B:
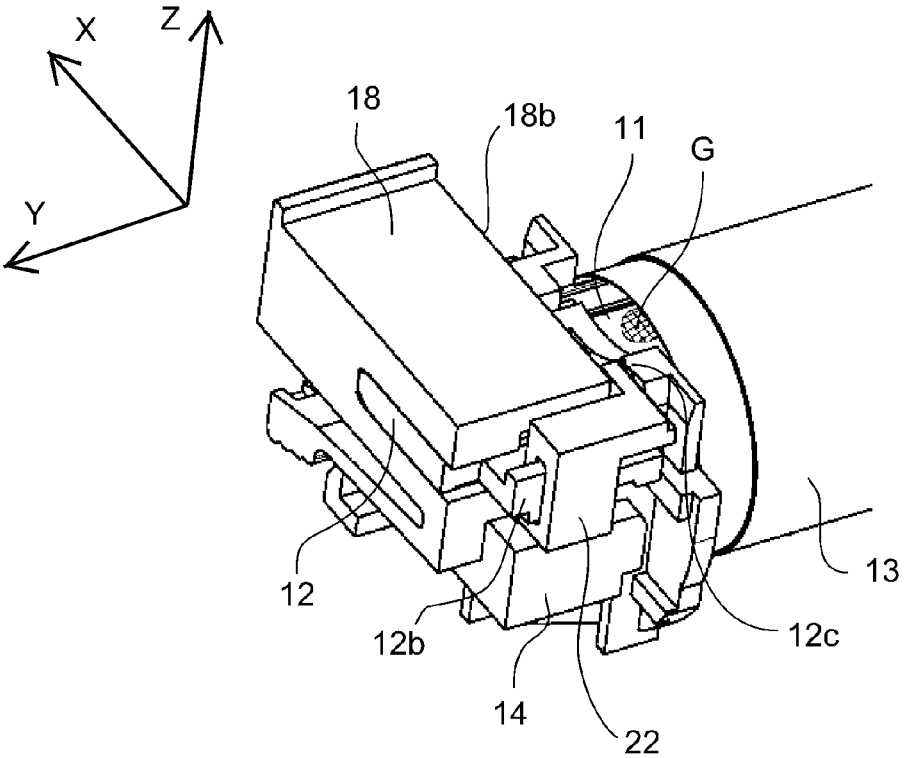

FIG. 12B is a perspective view showing a state in which the connector 18 and the sealing member 22 are mounted to the film guide 12. The sealing member 22 mounted to the film guide 12 by being slid in the longitudinal direction is prevented by a stopper portion 12*c* of the film guide 12 from moving in the longitudinal direction. The connector 18 is provided outside the sealing member 22 with respect to the longitudinal direction. Therefore, after the sealing member 22 is mounted, also an end surface 18*b* of the connector 18 mounted in the widthwise direction (X-axis direction) prevents movement of the sealing member 22 in the longitudinal direction (Y-axis direction). That is, with respect to the longitudinal direction, the sealing member 22 is sandwiched between the end surface 18*b* of the connector 18 and the stopper portion 12*c* of the film guide 12, and therefore, the sealing member 22 is not detached due to impact, vibration or the like. Incidentally, a function of preventing the movement of the sealing member 22 in the longitudinal direction may also be provided to the fixing flange 14.

Figure 12C:
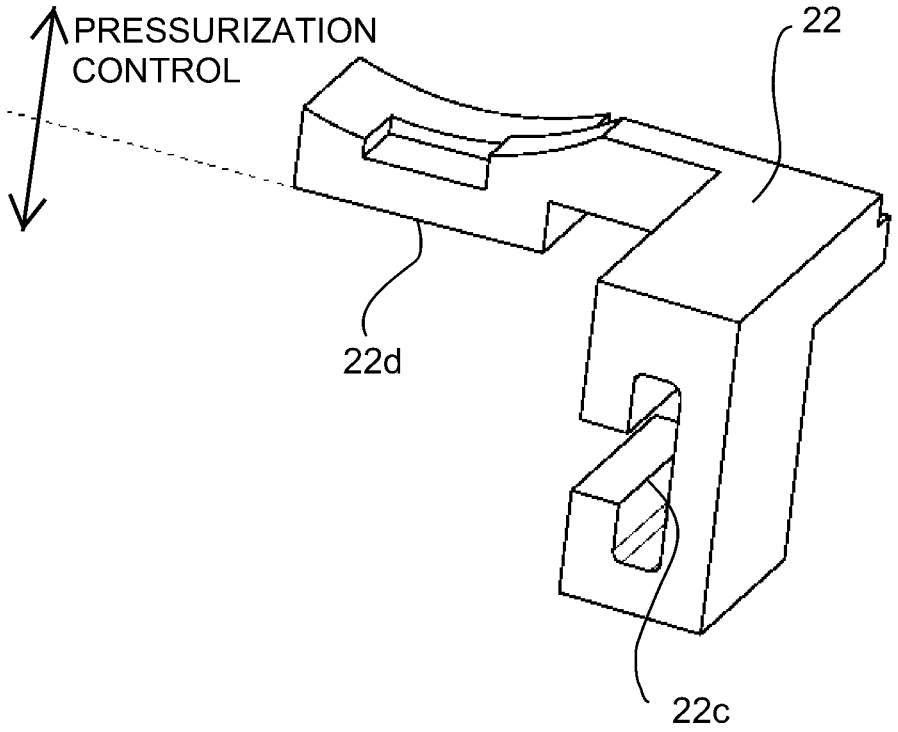

FIG. 12C is a perspective view of the sealing member 22 alone in this embodiment. As a material of the sealing member 22, the heat-resistant resin material such as LCP or PPS is used. When a fixing property of an image end portion is taken into consideration, as the material of the sealing member 22, a material having a small thermal capacity may preferably be used. Further, by a height of the contact portion 22*d* of the sealing member 22 with respect to a thickness direction (Z-axis direction), the preload is easily controlled. Even when the preload is increased, the engaging portion 22*c* of the sealing member 22 engages with the portion-to-be-engaged 12*b* of the film guide 12, and therefore the sealing member 22 is not readily disengaged. Incidentally, the sealing member 22 is also provided in an opposite side with respect to the longitudinal direction.

Figure 13:
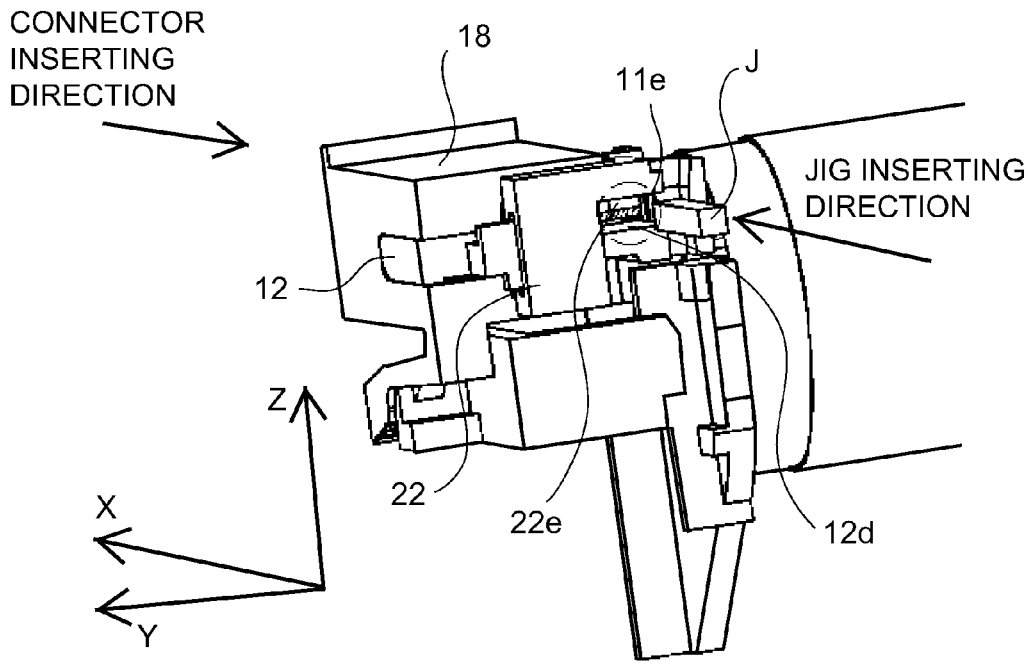
In FIG. 13, (a) and (b) are schematic views for illustrating another example of the sealing member of a fixing device in Embodiment 3.
Figure 13:
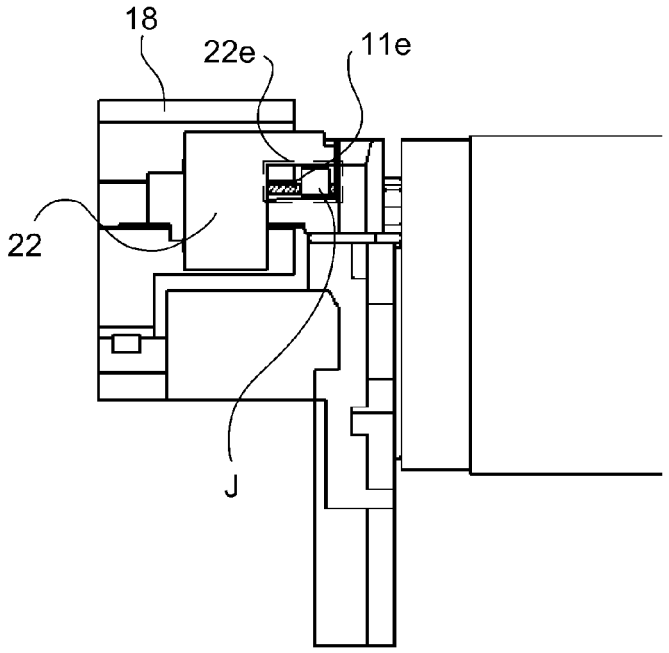

In FIG. 13, (a) is a perspective view showing a heater end portion abutting jig J and a periphery thereof in an assembling step of the fixing device, and (b) is a schematic view of the jig (tool) J as seen in the widthwise direction (X-axis direction). In the case where the heater 11 is not bonded to the film guide 12, when the connector 18 is mounted in the widthwise direction (X-axis direction), the heater 11 shifts in the widthwise direction (X-axis direction) by its sliding resistance. In order to prevent the shift of the heater 11, during the mounting of the connector 18, at the same time, the jig J for urging the heater end portion 11*e* in one direction of the widthwise direction (X-axis direction) is used in some instance. The film guide 12 is provided with a recessed portion 12*d* with respect to a heater thickness direction so that the film guide 12 does not interfere with an insertion locus of the jig J for the purpose of enabling abutment of the jig J against the heater end portion 11*e*.

Further, when the sealing member 22 is provided, the sealing member 22 closes the gap between the jig J and the heater end portion 11*e* (i.e., the sealing member 22 itself interferes with the insertion locus of the jig J), so that abutment urging of the heater end portion 11*e* by the jig J cannot be effected. In order to prevent this, the sealing member 22 is provided with a penetrating portion 22*e* penetrating from an outside thereof to the heater end portion 11*e* with respect to the widthwise direction (X-axis direction). As a result, the heater end portion 11*e* can be abutted and urged by the jig J from the outside of the sealing member 22, so that even during the mounting of the connector 18, the heater 11 can be urged in one direction of the widthwise direction and it is possible to suppress the shift of the heater 11 in the widthwise direction (X-axis direction) of the heater 11. The constitution shown in FIG. 13 is also provided in an opposite side, and thus is employed at both end portions of the heater 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-188321 filed on Sep. 25, 2015, and 2016-143011 filed on Jul. 21, 2016, which are hereby incorporated by reference herein in their entirety.

What is claimed is:

1. A fixing device for fixing an image, formed on a recording material, onto the recording material, the fixing device comprising:

a cylindrical film;

a heater contacting an inner surface of said film;

a supporting member for supporting said heater, said supporting member being provided in a hollow space of said film;

a first portion for preventing lateral movement of said film in a generatrix direction of said film by receiving an end surface of said film, said first portion being supported by a frame of said fixing device and holding said supporting member; and a second portion opposed to a surface of said heater that contacts said film and elongated along a widthwise direction of said heater, said second portion being provided at the same position as said first portion with respect to the generatrix direction of said film.

2. A fixing device according to claim 1, wherein said second portion is mounted to said supporting member by sliding with said supporting member in the generatrix direction of said film.

3. A fixing device according to claim 1, wherein said heater includes an electrode portion for supplying electrical power to said heater, said electrode portion being provided at a position outside of an end portion of said film with respect to the generatrix direction of said film, and at an end portion of said heater with respect to the generatrix direction of said film.

4. A fixing device according to claim 1, wherein said second portion is located on the opposite side of said film to said first portion with respect to the generatrix direction of said film.

5. A fixing device for fixing an image, formed on a recording material, onto the recording material, the fixing device comprising:

(A) a roller; and (B) a film unit that forms a nip in cooperation with said roller, the recording material being fed through the nip, said film unit comprising:

(a) a cylindrical film;

(b) a heater contacting an inner surface of said film;

(c) a supporting member for supporting said heater, said supporting member being provided in a hollow space of said film;

(d) a first portion for preventing lateral movement of said film in a generatrix direction of said film by receiving an end surface of said film, said first portion being supported by a frame of said fixing device and holding said supporting member; and (e) a second portion opposed to a surface of said heater that contacts said film, said second portion being provided at the same position as said first portion with respect to the generatrix direction of said film.

6. A fixing device according to claim 5, wherein said second portion is mounted to said supporting member by sliding with said supporting member in the generatrix direction of said film.

7. A fixing device according to claim 5, wherein said heater includes an electrode portion for supplying electrical power to said heater, said electrode portion being provided at a position outside of an end portion of said film with respect to the generatrix direction of said film, and at an end portion of said heater with respect to the generatrix direction of said film.

8. A fixing device for fixing an image, formed on a recording material, onto the recording material, the fixing device comprising:

a cylindrical film;

a heater contacting an inner surface of said film;

a supporting member for supporting said heater, said supporting member being provided in a hollow space of said film;

a first portion for preventing lateral movement of said film in a generatrix direction of said film by receiving an end surface of said film, said first portion being supported by a frame of said fixing device and holding said supporting member; and a second portion opposed to a surface of said heater that contacts said film and mounted to said supporting member by sliding with said supporting member in the generatrix direction of said film, said second portion being provided at the same position as said first portion with respect to the generatrix direction of said film.

9. A fixing device according to claim 8, wherein said heater includes an electrode portion for supplying electrical power to said heater, said electrode portion being provided at a position outside of an end portion of said film with respect to the generatrix direction of said film, and at an end portion of said heater with respect to the generatrix direction of said film.

10. A fixing device according to claim 8, wherein said second portion is located on the opposite side of said film to said first portion with respect to the generatrix direction of said film.

11. A fixing device for fixing an image, formed on a recording material, onto the recording material, the fixing device comprising:

a cylindrical film;

a heater contacting an inner surface of said film;

a supporting member for supporting said heater, said supporting member being provided in a hollow space of said film, said supporting member having a first end portion and a second end portion in a generatrix direction of said film;

two first portions for preventing lateral movement of said film in the generatrix direction of said film, said two first portions being supported by a frame of said fixing device and holding the first end portion of said supporting member with respect to the generatrix direction of said film; and a second portion opposed to a surface of said heater that contacts said film, said second portion being provided between said two first portions in a widthwise direction of said heater.

12. A fixing device according to claim 11, wherein said second portion is mounted to said supporting member by sliding with said supporting member in the generatrix direction of said film.

13. A fixing device according to claim 11, wherein said heater includes an electrode portion for supplying electrical power to said heater, said electrode portion being provided at a position outside of an end portion of said film with respect to the generatrix direction of said film, and at an end portion of said heater with respect to the generatrix direction of said film.

14. A fixing device according to claim 11, wherein said second portion is located on the opposite side of said film to said two first portions with respect to the generatrix direction of said film.

15. A fixing device for fixing an image, formed on a recording material, onto the recording material, the fixing device comprising:

(A) a roller; and (B) a film unit that forms a nip in cooperation with said roller, the recording material being fed through the nip, said film unit comprising:

(a) a cylindrical film;

(b) a heater contacting an inner surface of said film;

(c) a supporting member for supporting said heater, said supporting member being provided in a hollow space of said film, said supporting member having a first end portion and a second end portion in a generatrix direction of said film;

(d) two first portions for preventing lateral movement of said film in the generatrix direction of said film, said two first portions being supported by a frame of said fixing device and holding the first end portion of said supporting member with respect to the generatrix direction of said film; and (e) a second portion opposed to a surface of said heater that contacts said film, said second portion being provided between said two first portions in a widthwise direction of said heater.

16. A fixing device according to claim 15, wherein said second portion is mounted to said supporting member by sliding with said supporting member in the generatrix direction of said film.

17. A fixing device according to claim 15, wherein said heater includes an electrode portion for supplying electrical power to said heater, said electrode portion being provided at a position outside of an end portion of said film with respect to the generatrix direction of said film, and at an end portion of said heater with respect to the generatrix direction of said film.

18. A fixing device according to claim 15, wherein said second portion is located on the opposite side of said film to said two first portions with respect to the generatrix direction of said film.

* * * * *